United States Patent [19]

Friesen et al.

[11] 4,082,199

[45] Apr. 4, 1978

[54] LIFT TRUCK MAST STABILIZER

[75] Inventors: Larry Dean Friesen; Richard James Johannson, both of Dallas, Oreg.

[73] Assignee: Towmotor Corporation, Mentor, Ohio

[21] Appl. No.: 702,660

[22] Filed: Jul. 6, 1976

[51] Int. Cl.[2] ..... B66F 9/08

[52] U.S. Cl. ..... 214/672; 187/1 R; 187/9 R

[58] Field of Search ..... 187/1 R, 9 R, 9 E, 95; 214/671, 672, 673, 674, DIG. 7; 280/756; 296/102

[56] References Cited

U.S. PATENT DOCUMENTS

| | | | |
|---|---|---|---|
| 2,263,978 | 11/1941 | Branovic et al. | 280/756 X |
| 2,263,981 | 11/1941 | Dalecke et al. | 214/672 |
| 2,337,109 | 12/1943 | Johnson | 214/672 |
| 2,754,019 | 7/1956 | Watson | 214/674 |
| 2,810,489 | 10/1957 | Davies | 280/756 X |
| 2,911,232 | 11/1959 | Hastings et al. | 280/756 |
| 3,199,699 | 8/1965 | Dayton | 214/654 |

FOREIGN PATENT DOCUMENTS

| | | | |
|---|---|---|---|
| 2,455,988 | 6/1975 | Germany | 214/674 |

*Primary Examiner*—Evon C. Blunk
*Assistant Examiner*—James L. Rowland
*Attorney, Agent, or Firm*—Wegner, Stellman, McCord, Wiles & Wood

[57] ABSTRACT

A stabilizer is provided for the mast of a lift truck for resisting torsional forces applied to the elevating system as the lift truck changes attitude. The stabilizer includes a pair of "A" frames with the apexes of the frames pivotally secured together. The spaced legs of the frames are connected, in the case of the one "A" frame, to the respective uprights of the mast and, in the case of the other "A" frame, to the vehicle chassis or fender. The connections between the "A" frames, the mast and the vehicle chassis are such that the forward and rearward tilt of the mast is not restricted, but twisting forces between the mast and the chassis are restrained. The "A" frames also provide a protective guard for the operator's cab and, because of the openings through the frames, the frames do not restrict the visibility of the operator.

6 Claims, 4 Drawing Figures

38
42
40
III
IV
IV
III
II
26
30
20
22
24
28
110
II
34
36
14
12
33
10
16

53
122
55
42
38
40
120
86
30
32

82
116
84
80
94
88
96
90
92
98
100
102
104
112
106
108
114

LIFT TRUCK MAST STABILIZER

BACKGROUND OF THE INVENTION

1. Field of the Invention

This invention relates to lift trucks and, more particularly, to a stabilizing system for the mast to reduce torsional forces between the mast and the chassis.

2. Description of the Prior Art

Lift trucks of conventional and/or specialized design have a pair of mast uprights pivotally connected to the chassis of the vehicle near the lower portions thereof. When certain types of loads are carried on the forks projecting from the mast, such as when long loads or when heavy loads are carried by the forks on the mast, extreme torsional forces are placed upon the mast tending to twist the mast relative to the chassis of the vehicle as the vehicle traverses an uneven terrain. This can cause excessive flexing of the mast structural members and joints causing fatigue failures and a breakdown of the machine or causing the loads on the forks to be dumped or dropped.

Heretofore, there have been many attempts made to provide protective guards for the operator of the lift truck, which guards take the form of structural shields connected to the chassis and, frequently, to the lift uprights so as to hold a guard member over the head of the operator.

One such patent is the patent to Watson, U.S. Pat. No. 2,754,019, issued July 10, 1956, which shows a protective guard carried by the masts and by a pair of supports from the chassis of the vehicle. The patent to Dalecke et al. U.S. Pat. No. 2,263,981, issued Nov. 25, 1941, also has a pair of members connected to the mast with a pair of supports connected to the rear of the vehicle to support a guard over the head of the operator. The patent to Dayton, U.S. Pat. No. 3,199,699, issued Aug. 10, 1965, provides not only for the mast being fixed, but also for various mechanisms for holding a load on the forks including a rigid member extending between the mast and the chassis of the vehicle, which rigid member is intended to protect the operator and to lock the mast in a vertical position.

The Watson and Dalecke et al. patents do not provide any stabilizing means for the mast. The Dayton patent, even if it could be said to serve as a stabilizing means, locks the mast in a vertical operating position and is not capable of permitting the mast to be tilted relative to the vehicle as is required in conventional lift operations.

SUMMARY OF THE INVENTION

An efficient stabilizing means has been provided by pivotally connecting together the apexes of a pair of "A" frames with the legs of one "A" frame being pivotally connected to the mast uprights and the legs of the other "A" frame being pivotally connected to the chassis of the vehicle. Thrust washers and spherical bearings are provided between the two "A" frames, and between the one "A" frame and the chassis or fender of the vehicle to permit misalignments of the one "A" frame relative to the other "A" frame or between the one "A" frame and the chassis or fender of the vehicle without binding or otherwise locking up the mechanism.

Since the connections between the "A" frames, and between the "A" frames, the mast uprights and the chassis of the vehicle are pivotal connections, it can be seen that the mast may be tilted fore and aft as is conventional which will shift the one "A" frame relative to the other, at the same time holding the mast in a single plane and resisting any tendency for the mast to twist or distort relative to the chassis of the vehicle.

In one preferred form of our invention, the stabilizer is formed of tubular members which, when combined with the "A" frame construction, produces trusses which are strictly tension and compression members. Due to the use of the tubular-shaped members, the stabilizer can be easily fabricated at relatively low cost with a high stiffness to weight ratio. Phenolic thrust washers are used at the hinge joints to absorb side loadings which washers, together with the spherical bushings, permit looser manufacturing tolerances, thereby, further reducing the manufacturing costs.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
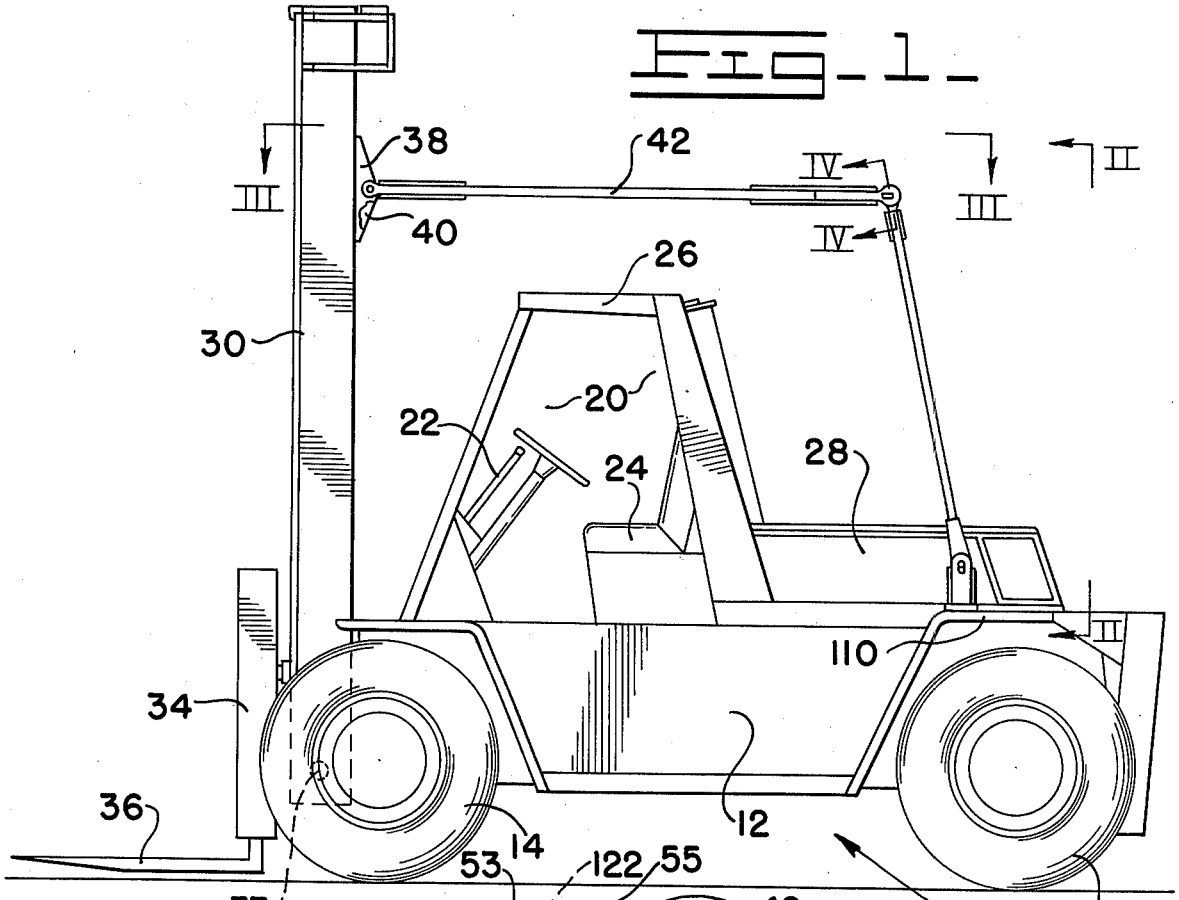
FIG. 1 is an elevational view of a lift truck having our improved stabilizing means.
Figure 2:
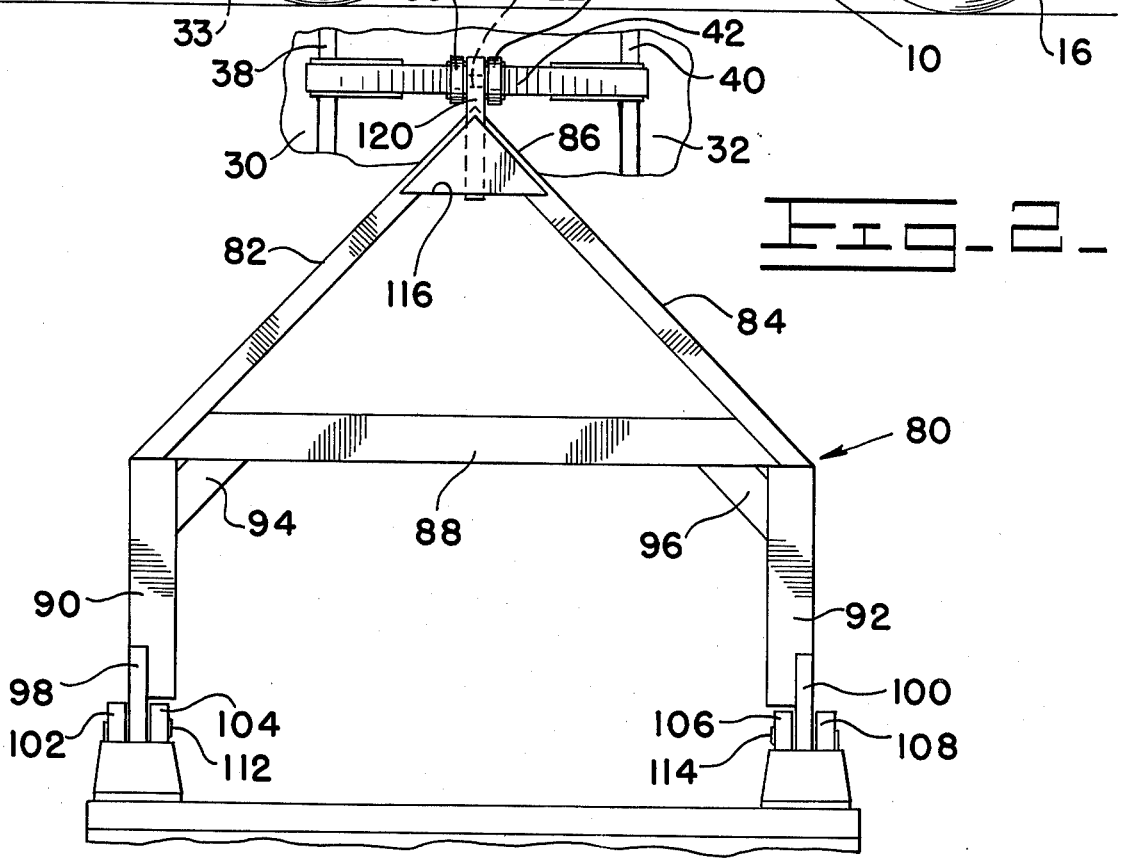
FIG. 2 is an end view taken along the lines 2—2 of FIG. 1.
Figure 3:
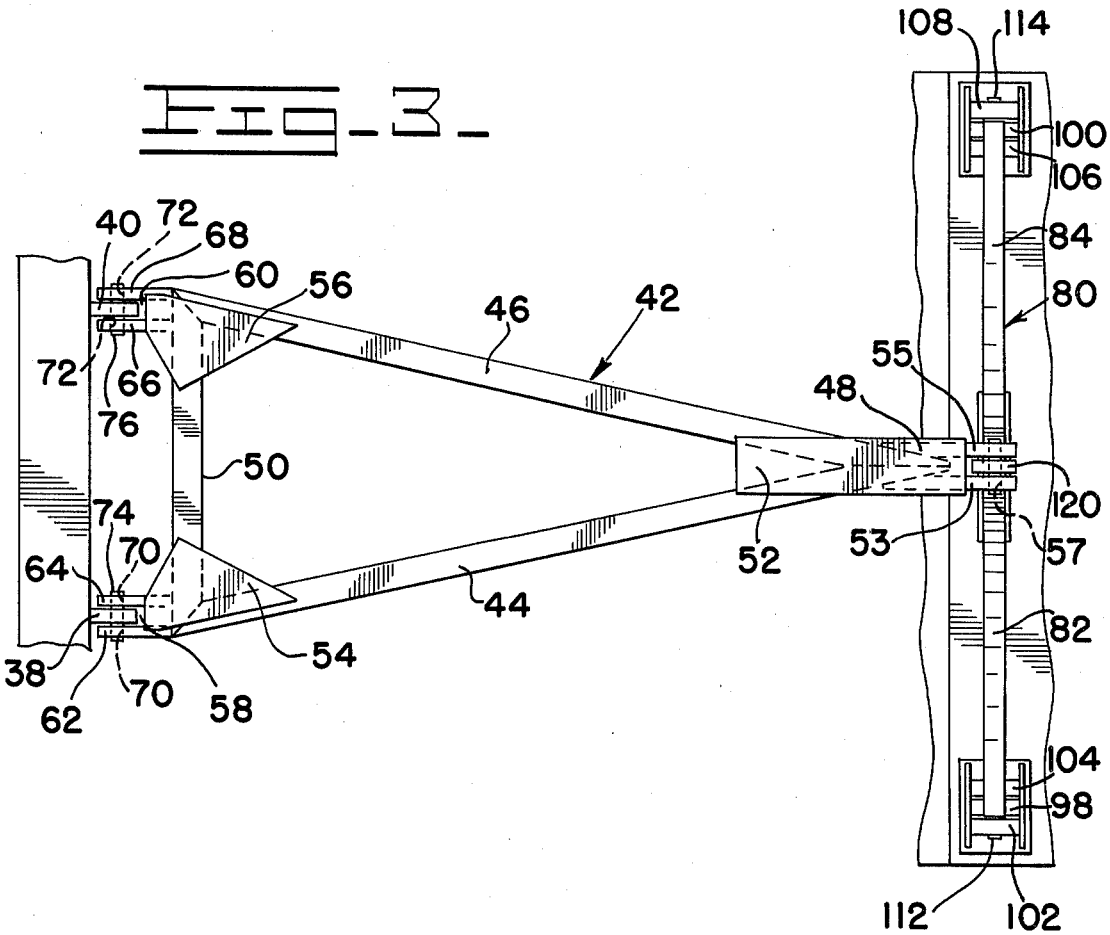
FIG. 3 is a top plan view of the stabilizer taken along the lines 3—3 of FIG. 1.

FIG. 1 illustrates, broadly, a lift truck 10 having a chassis 12 supported by front wheels 14 and rear wheels 16. On the chassis 12 is an operator station 20 which includes controls 22 and an operator seat 24. A cab 26 encases the operator station 20 and permits four-way visibility while providing protection for the operator. The chassis 12 also includes an enclosed power plant 28 and a mast having a pair of uprights 30 and 32 pivotally connected at 33 to the chassis 12 near the lower portion thereof. A lift apron 34, having forwarding projecting forks 36, is mounted on the mast uprights 30,32 and is adapted to be raised and lowered relative thereto.

The lift truck 10, just described, is of fairly conventional construction and contains operating mechanisms making it possible to tilt the mast uprights 30,32 forward and aft of the upward position in a conventional fashion. For the purposes of the present disclosure, any lift truck vehicle having a pair of mast uprights 30,32 pivotally connected thereto is all that is essential. Mounted near the upper portion of the mast uprights 30 and 32, are rearwardly extending brackets 38 and 40 with the apex of each bracket projecting rearwardly of said uprights 30 and 32.

An "A" frame 42 is comprised of two main legs 44 and 46 joined together at an apex 48 at one end and has a cross bar 50 extending between said legs 44,46 at the other end thereof. A plate 52 bridges the legs 44,46 at the apex 48 to reinforce said frame at said apex. A pair of spaced apart bars 53,55 project from the apex 48 and from the plate 52 and have aligned openings 57 therethrough. Reinforcing plates 54 and 56 bridge the area between the cross bar 50 and the main legs 44,46 so as to add rigidity to the frame 42. The extended end portions 58,60 of the main legs 44,46 of the "A" frame 42 are parallel to each other with each end portion 58,60 being comprised of a pair of spaced parts 62,64 and 66,68, respectively, with aligned openings 70,72 passing therethrough. The openings 70, of one pair of end portions 58 forming one leg 44, align with the openings 72 of the other pair of end portions 60 forming the other leg 46. The parts 62,64 forming the end portion of one leg 44 bridge the bracket 38 on the upright 30 while the parts 66,68 forming the end portion of the other leg 46 bridge the other bracket 40 of the other upright 32. Pins. 74,76 are passed through the aligned openings 70,72 in the legs 44,46 and the brackets 38,40 to pivotally support the mast uprights 30,32 to the legs of the "A" frame 42.

A second "A" frame 80 is provided with diverging tubular legs 82,84 joined together at one end at an apex 86 and are supported apart by a cross bar 88 secured to each of said legs. The legs 82,84 have extended end portions 90,92 on each side of the frame 80 which portions are parallel to each other and have reinforcing brackets 94,96 extending therefrom to the cross bar 88 so as to provide a rigid structural member. Each parallel portion 90,92 of the "A" frame 80 has elongate elements 98,100 on the end thereof, each one of which is adapted to nest between or be sandwiched between a pair of spaced trunnions 102,104 and 106,108, respectively, fixed on the chassis 12 of the lift truck 10. The trunnions could be supported on the rear fender 110 of the lift truck 10 or on the chassis 12 depending upon the demands and upon the construction of the vehicle. Pins 112,114 pass between each pair of trunnions 102,104 and 106,108 and the elongate elements 98,100 of the "A" frame 80 so that the legs 82,84 of the frame 80 are pivotally mounted to the lift truck 10.

The apex 86 of the "A" frame 80 has reinforcing plates 116 extending between the legs 82,84 thereof so as to add rigidity to the frame 80. A projecting tongue member 120 extends forwardly from the apex 86 of the frame 80 and has an opening 122 extending transversely therethrough. The spaced bars 53,55 of the "A" frame 42 will embrace the tongue 120 of the frame 80 with a pin 124 passing through the aligned openings 57 and 122 in said frames 42,80, respectively. The pin pivotally connects the apexes of the two frames 42,80 together.

Figure 4:
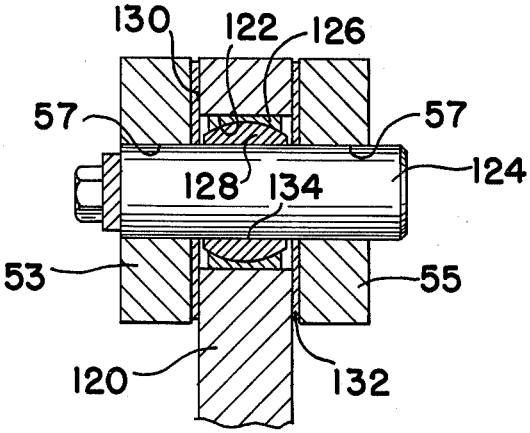
FIG. 4 is a cross-sectional view taken along the lines of 4—4 of FIG. 1.

As shown in FIG. 4, the tongue 120 of the "A" frame 80 has a socket 126 and a spherical bearing 128 seated in the opening 122 therein. A pair of thrust washers 130,132, which may be made of phenolic resin material, are positioned between the side faces of the tongue 120 of the "A" frame 80 and the inner surfaces of the projecting bars 53,55 of the "A" frame 42. The pin 124 passes through the openings 57 in the bars 53,55, through the thrust washers 130,132, and through the opening 134 in the spherical bearing 128 in the tongue 120 so that limited misalignment between the "A" frame 42 and the "A" frame 80 is permitted.

Spherical bearings 128 and phenolic thrust washers 130,132 are also provided between the elements 98,100, the "A" frame 80 and the trunnions 102,104 and 106,108 carried by the lift truck. This will permit a limited amount of misalignment during assembly of the "A" frame 80 to the lift truck chassis 12 or fenders 110.

With the legs 82,84 of the "A" frame 80 connected to the lift truck through the spherical bearing connections 128 and the thrust washers 130,132 and with the apex 86 of the "A" frame 80 pivotally connected to the apex 48 of the "A" frame 42 through a like spherical bearing connection 128, a rapid and efficient connection between the two "A" frames 42,80 and the "A" frame 80 and the lift truck 10 is permitted. The pin connections 74,76 between the legs 44,46 of the "A" frame 42 and the respective uprights 30 and 32 provides for pivoting movement between the uprights 30,32 and the "A" frame 42 in a vertical plane but provides no appreciable movement therebetween outside said vertical plane. In this way, the uprights 30 and 32 are stabilized and prevented from twisting or distorting relative to each other. Due to the mountings of the respective "A" frames 42,80, the uprights 30 and 32 will be supported for tilting movement only. The operator may tilt the uprights 30,32 forward or rearward about pivots 33, which movement will be permitted by the stabilizing construction. Due to the connections between the uprights 30,32 and the "A" frame 42, between the two "A" frames 42,80 and between the "A" frame 80 and the lift truck chassis 12, the stabilizing structure will function like the two legs of a parallelogram and permit movement in the plane of the parallelogram but resists movement out of the plane of the parallelogram.

The "A" frames being of tubular configuration offer a stiff structural member efficiently shaped for transmitting torsional loads from the elevating system to the vehicle chassis. The principal advantages to the "A" frame construction are that the members of the "A" frames are strictly in tension or compression and, since they are tubularly shaped, they are easy to fabricate and give a very high stiffness to weight ratio. Side loadings on the hinge joints, between the apexes 48,86 of the two "A" frames and between the legs of the "A" frame and the vehicle, are taken up or absorbed by the phenolic thrust washers 130, 132 which are sandwiched between the overlapping interfitting parts of the joints. The incorporation of the spherical bearings 128 allows for looser manufacturing tolerances, ease in assembly and efficiency in operation. The result is a lift truck with a mast that is very stable relative to the chassis of the vehicle, when the lift truck is used to move, for instance, long loads of uneven distribution, such as logs or lumber, the stabilizer will not permit the mast to twist out of the plane relative to the vehicle chassis, which twisting is due to the swinging effect of the load on the forks. Also, with high inertial loads carried on the forks, as the forklift is moved over rough terrain wherein the vehicle is caused to pitch or tilt as it moves, will encounter no difficulty caused by twisting of the mast since the mast is stabilized. The "A" frame stabilizers also serve as operator protective guards which, in effect, gives a double protection to the operator. That is, the operator cab 26 provides initial protection with secondary protection being provided by the "A" frames 42,80 of the stabilizing structure. The stabilizing structure does not, in any way, limit the function and operation or utility of the forklift and, at the same time, provides stabilization for the mast thereby improving the life and usefulness of the forklift.

What is claimed is:

1. In a mast stabilizing means for a lift truck comprising a chassis, a mast having a pair of pivotally mounted, vertically extending, substantially parallel uprights carried by said chassis, stabilizing means pivotally connected to said chassis and to said uprights for stabilizing said uprights against twisting, said stabilizing means comprising a horizontally disposed "A" frame having a pair of legs pivotally connected to the pair of uprights, a vertically disposed "A" frame having a pair of legs with the spaced apart ends of said legs being pivotally connected to spaced apart parts of the chassis of the vehicle, the apexes of the horizontal "A" frame and the vertical "A" frame being pivotally connected together for movement in a plane perpendicular to the axis of the pivotal connection between said two "A" frames whereby said "A" frames stabilize said mast relative to said chassis.

2. In a mast stabilizing means as claimed in claim 1 wherein said pivotal connection between said "A" frames includes a spherical bearing carried by one "A" frame and a mating socket carried by the other "A" frame, said spherical bearing nesting in said mating socket to permit movement in said plane perpendicular to the axis of said pivotal connection between said "A" frames.

3. In a mast stabilizing means as claimed in claim 1 wherein said legs of said vertical "A" frame are pivotally connected to said chassis by means of interfitting spherical bearings and mating sockets.

4. In a lift truck having a chassis and a mast pivotally connected to said chassis, said mast includes two uprights pivotally connected to said chassis, stabilizing means for said mast, said stabilizing means comprising a horizontally disposed "A" frame pivotally connected to said mast, said "A" frame has a pair of legs with spaced apart end portions, said spaced apart end portions of said legs being pivotally connected to said uprights, a vertically disposed "A" frame having a pair of legs with the spaced apart end portions being pivotally connected to the chassis of the vehicle, the apex of said vertical "A" frame being pivotally connected to said horizontal "A" frame to permit movement in a plane perpendicular to the axis of the pivotal connection between said vertical "A" frame and the horizontal "A" frame whereby said mast is stabilized relative to said chassis.

5. In a lift truck as claimed in claim 4 wherein said horizontal "A" frame has an apex which is pivotally connected to said vertical "A" frame by means of a mating spherical bearing and socket connection.

6. In a lift truck as claimed in claim 5 wherein said legs of the vertical "A" frame are spaced apart at one end portion, said spaced portion of said legs of the vertical "A" frame being pivotally connected to said chassis by means of mating spherical bearings and sockets.

* * * * *